United States Patent [19]

Eysn

[11] 4,261,554

[45] Apr. 14, 1981

[54] TAP-HOLE CLOSING ARRANGEMENT OF A METALLURGICAL VESSEL

[75] Inventor: Manfred Eysn, Linz, Austria

[73] Assignee: Voest-Alpine Aktiengesellschaft, Linz, Austria

[21] Appl. No.: 82,947

[22] Filed: Oct. 9, 1979

[30] Foreign Application Priority Data

Oct. 24, 1978 [AT] Austria ..... 7606/78

[51] Int. Cl.[3] ..... C21C 5/48

[52] U.S. Cl. ..... 266/272; 266/195; 266/236

[58] Field of Search ..... 266/45, 90, 195, 236, 266/271, 272; 164/154, 155

[56] References Cited

U.S. PATENT DOCUMENTS

| | | | |
|---|---|---|---|
| 3,973,761 | 8/1976 | Pelletier et al. | 266/272 |
| 4,079,918 | 3/1978 | Truppe et al. | 266/45 |
| 4,131,219 | 12/1978 | Hind et al. | 266/236 |

*Primary Examiner*—L. Dewayne Rutledge

*Assistant Examiner*—John P. Sheehan

*Attorney, Agent, or Firm*—Brumbaugh, Graves, Donohue & Raymond

[57] ABSTRACT

An arrangement for closing the tap hole of a metallurgical vessel designed for separating metal and slag, includes a closure body which is insertable into the tap hole so as to leave free an annular gap relative to the tap hole wall. The closure body contains a compressed-gas conduit and has an outer jacket tapering towards the mouth of the compressed-gas conduit. In order to ensure the maintenance of an annular gap of constant size, and thus the original diameter of the tap hole, the tap hole is set off in step-like manner by two parts so as to widen outwardly. The outer tap hole part has a larger diameter than that the inner part, which is delimited by the lining of the metallurgical vessel. The outer part is formed by a hollow body whose inner ring wall surrounds the outer jacket of the closure body peripherally at a radial distance. The hollow body also has a cavity into which at least one supply and one discharge conduit for a coolant enter.

3 Claims, 2 Drawing Figures

TAP-HOLE CLOSING ARRANGEMENT OF A METALLURGICAL VESSEL

BACKGROUND OF THE INVENTION

According to U.S. Pat. No. 4,079,918 an arrangement is provided for closing the tap hole of a metallurgical vessel in which a closure body that is insertable into the tap hole so as to leave free an annular gap relative to the tap hole wall, contains a compressed-gas conduit. The closure body preferably comprises an outer jacket that tapers towards the mouth of the compressed-gas conduit.

Such an arrangement serves for enabling a separation of metal and slag during tapping, wherein the known arrangement is particularly easy to handle and can be applied repeatedly, i.e. even when the lining of the tap hole has already been subject to wear. With this known arrangement, air of the environment streams through the annular gap into the tap hole according to the injector principle when the closure body is in the closing position. As a result the size of the annular gap is of decisive importance with respect to the sealing effect. In case of wear of the lining of the tap hole, the diameter of the tap hole will increase, so that towards the end of a converter campaign more air of the environment will be sucked in. This causes the sealing effect of the closure arrangement to be lowered or to be maintained only by blowing more compressed air into the tap hole. It is therefore necessary to service and repair the tap hole within certain spans of time, the diameter of the tap hole having to be restored to about its original size by applying refractory mass thereto. This maintenance work can be carried out only between two heats. The time consumption connected therewith results in an extension of the average heat time and thus a reduction in the production.

SUMMARY OF THE INVENTION

The invention aims at improving the known arrangement in such a manner that permanent repair work for maintaining the original diameter of the tap hole is no longer required during a converter campaign, so that the lining may be subject to wear without reducing the sealing effect of the closure arrangement.

This object is achieved according to the invention in that the tap hole is set off in step-like manner so as to widen outwardly. That part of the tap hole which has a larger diameter than the tap hole part delimited by the lining of the metallurgical vessel is formed by an annular hollow body whose inner ring wall peripherally surrounds the outer jacket of the closure body at a radial distance and into whose cavity at least one supply conduit and one discharge conduit enter.

According to a preferred embodiment, the hollow body has the shape of a circular ring plate closely contacting the lining of the metallurgical vessel. The circular ring plate additionally serves as a support of the lining of the tap hole.

BRIEF DESCRIPTION OF THE DRAWINGS

The invention will now be described in more detail with reference to the accompanying drawings, wherein.

DESCRIPTION OF AN ILLUSTRATIVE EMBODIMENT

Figure 1:
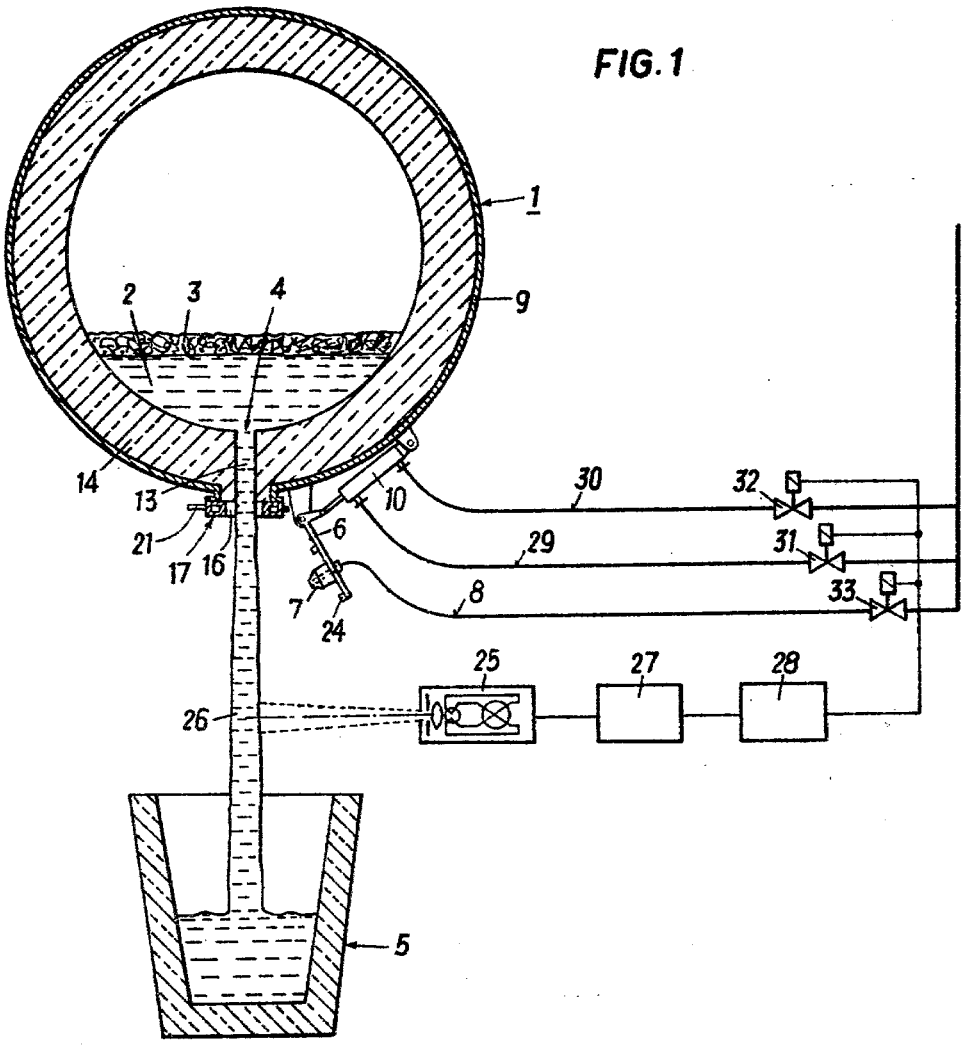
FIG. 1 is a section through a refining vessel during tapping of a steel melt into a casting ladle, which is also illustrated in section.

In the refining vessel 1, there is a steel melt 2 with a slag layer 3 floating on it. The steel flows through the tap hole 4 into the casting ladle 5 situated therebelow. For closing the tap hole there is provided a closure body 7 fastened at a pivot arm 6, to which closure body a compressed-gas conduit 8 is connected. The pivot arm 6 is hinged to the outer jacket 9 of the refining vessel 1 and is pivotable by a pressure medium cylinder 10, which cylinder is actuatable in both directions and is hinged to the outer jacket of the vessel. The closure body 7 comprises an outer jacket 11 that tapers towards the mouth of conduit 8.

The tap hole 4 is stepwisely set off so as to widen outwardly, i.e. part 13 of the tap hole has a diameter 12 when the refining vessel is newly lined by lining 14 of the refining vessel 1, and part 16 of the tap hole 4 has a diameter 15 larger by the measure *a* than part 13. Part 16 is delimited by a circular plate-shaped hollow body 17 which is fastened to a flange 18 of the outer jacket 9 of the refining vessel 1. A cavity 19 of the hollow body 17 has a coolant flowing through it with conduit 20 serving as a supply conduit and conduit 21 serving as a discharge conduit.

The inner ring wall 22 of the hollow body peripherally surrounds the closure body 7 at a distance *b* when it has been pivoted into the closing position (FIG. 2), so that an annular gap 23 will be formed between the closure body 7 and the hollow body 17. Stops 24 provided on the pivot arm 6 secure the closing position of the closure body relative to the tap hole 4, thus preventing the closure body from being pivoted too far into the tap hole.

Closure of the tap hole is effected in the following manner: As soon as the steel has flowed off into the casting ladle 5, the slag 3 begins to flow out through the tap hole 4. A ratio pyrometer 25, with which the flowing-out stream 26 is watched, gives a pulse at the change from steel to slag. This pulse actuates a relay 28 via an amplifier 27, which relay thereupon transmits an electric signal to magnetic valves 31, 32, 33. These are installed in supply conduits 29, 30, 8, respectively of the pressure medium cylinder 10 and the closure body 7. The magnetic valve 32 is opened, whereby the pressure medium cylinder 10 causes the pivot arm 6 to be brought into the closing position illustrated in FIG. 2. At the same time, the magnetic valve 33 of the supply conduit of the closure body is actuated, whereby the closure body, which in the pivoted-back position shown in FIG. 1 is actuated with a partial pressure of the compressed gas for the purpose of cooling, will be actuated with the full pressure of the compressed gas. After reaching the closing position illustrated in FIG. 2, the compressed gas streaming out of the closure body 7 causes air to be sucked in through the annular gap 23 according to the injector principle, which is indicated by arrows in FIG. 2. Due to the compressed-gas air jet, the slag is forced back into the refining vessel and subsequently can be poured off into a separate slag vessel. As a compressed gas, air under pressure, argon or nitrogen may, for instance, be used.

Figure 2:
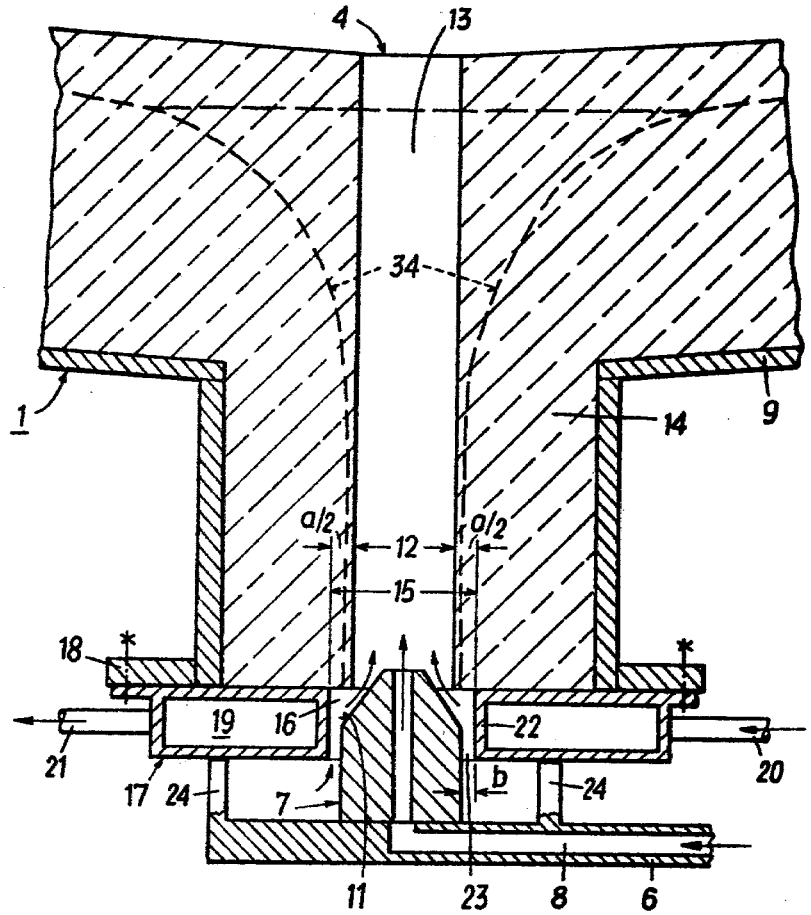
FIG. 2 illustrates a section through the closed tap hole along its axis, on an enlarged scale.

By means of the step-like shoulder of the tap hole, an equally large annular gap 23 will always be guaranteed between the tap hole wall and the closure body 7, thereby guaranteeing the sucking-in of a continuously equal amount of air of the environment, even with a worn lining 14 of the tap hole as illustrated in FIG. 2 by broken lines 34. Since the diameter 15 of the inner ring wall 22 of the hollow body 17 is chosen to be larger than the diameter 12 of the part 13 of the tap hole which is formed by the lining 14, contact of the inner ring wall 22 with melt or slag, and thus damage to the inner ring wall, are prevented. As a result the tap hole can be closed equally as well at the end of a converter campaign as in the beginning when the converters are newly lined. The measure *a* is chosen to be big enough that a difference between the diameter of the inner ring wall 22 and the part 13 of the tap hole is guaranteed, even at the end of the converter campaign.

What I claim is:

1. In a tap-hole closing arrangement of a metallurgical vessel having a lining, wherein said arrangement is adapted for separating metal and slag and is of the type including a tap hole wall defining a tap hole, a closure body being insertable into said tap hole so as to leave free an annular gap relative to said tap hole wall, said closure body containing a compressed-gas conduit and an outer jacket, the improvement which is characterized in that said tap hole is set off in a step-like manner so as to widen outwardly , said tap hole wall including a first tap hole part and a second tap hole part, said first tap hole part having an inner diameter delimiting the tap hole and formed by the lining of said metallurgical vessel and said second tap hole part being formed by an annular hollow body having an inner ring wall delimiting the tap hole, said inner ring also defining a cavity, said inner ring wall having a diameter that is larger than the inner diameter of said first tap hole part, the inner ring wall of said hollow body surrounding said outer jacket of said closure body peripherally at a radial distance, and at least one supply conduit and one discharge conduit enter into said cavity.

2. A tap-hole closing arrangement as set forth in claim 1, wherein said closure body has the compressed-gas conduit ending in a mouth and the outer jacket of the closure body tapering towards said mouth.

3. A tap-hole closing arrangement as set forth in claim 1 or 2, wherein said hollow body has the shape of a circular ring plate that closely contacts the lining of said metallurgical vessel.

* * * * *